United States Patent [19]

Bubbers

[11] 4,021,614

[45] May 3, 1977

[54] WOOFER EQUALIZER

[75] Inventor: John J. Bubbers, Needham, Mass.

[73] Assignee: Teledyne, Inc., Los Angeles, Calif.

[22] Filed: Sept. 16, 1976

[21] Appl. No.: 723,943

Related U.S. Application Data

[63] Continuation of Ser. No. 537,319, Dec. 30, 1974, abandoned.

[52] U.S. Cl. ..... 179/1 VL

[51] Int. Cl.[2] ..... H04R 3/02

[58] Field of Search ..... 179/1 D, 1 E, 1 GA, 179/1 VL

[56] References Cited

UNITED STATES PATENTS

| | | | |
|---|---|---|---|
| 1,550,724 | 8/1925 | Hubbard | 179/100.1 TC |
| 1,675,031 | 6/1928 | Kolster | 179/1 D |
| 1,834,820 | 12/1931 | Bobb | 179/1 D |
| 1,883,624 | 10/1932 | Doran | 333/81 |
| 1,907,723 | 5/1933 | Bostwick | 179/1 D |
| 1,912,719 | 6/1933 | Nicolas | 333/81 |
| 1,990,099 | 2/1935 | Siy | 179/1 VL |
| 2,036,084 | 3/1936 | Roder | 333/81 |
| 2,179,840 | 11/1939 | Bucky | 179/1 E |
| 3,487,341 | 12/1969 | Grout | 179/1 VL |
| 3,715,501 | 2/1973 | Russell | 179/1 D |

FOREIGN PATENTS OR APPLICATIONS

| | | | |
|---|---|---|---|
| 707,728 | 1/1931 | France | 179/1 D |
| 1,108,268 | 3/1960 | Germany | 179/1 D |

*Primary Examiner*—George G. Stellar
*Attorney, Agent, or Firm*—Schiller & Pandiscio

[57] ABSTRACT

A speaker system is disclosed which comprises a woofer, a transformer secondary and a plurality of inductive and capacitive impedances. Switching means are provided for coupling selected taps of the transformer secondary through selected ones of the impedances so as to selectively add or subtract, according to the switch position, the amount of sound power output.

11 Claims, 2 Drawing Figures

WOOFER EQUALIZER

Figure 2:
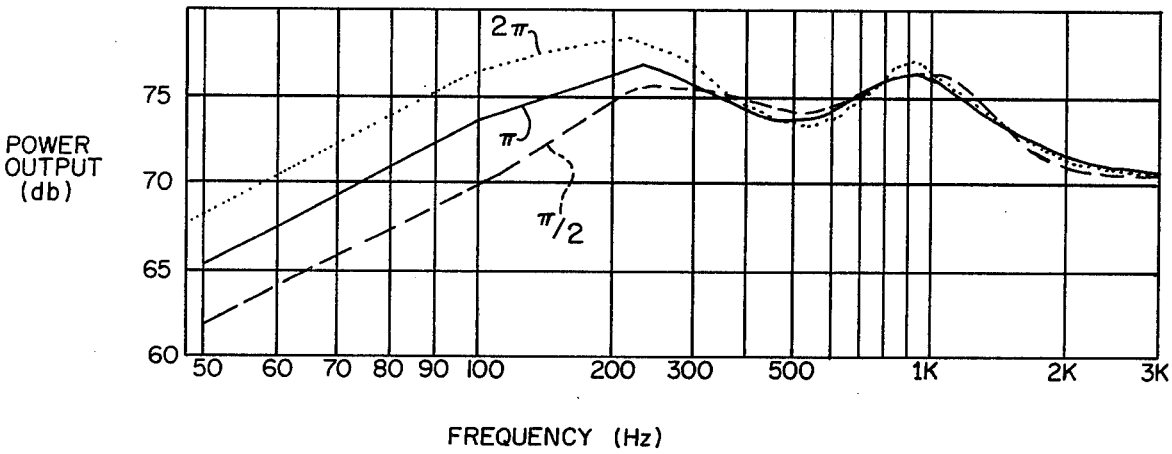

This application is a continuation of Ser. No. 537,319, filed Dec. 30, 1974, now abandoned.

This application relates to high fidelity loud speakers, and more particularly to low frequency equalization systems for loud speakers.

The manner in which the human ear reponds to elastic waves from a loud speaker is by perception of the sound pressure level. The latter, for a given sound power, is, inter alia, a function of the distance between the loud speaker and the listener. Since the efficiencies of the loud speakers are defined in terms of the sound power output of the speaker, the sound power is the usual measured parameter and can be considered a rough measure for approximation of the sound pressure level.

The sound power available from a speaker system (e.g., combined woofer, tweeter and midrange speakers), however, has been found to be a function of its position in a room. Thus, movement of the system from one location for which it is designed, to another location, will often impair the sound power output of the speaker so that it will not perform as a balanced system.

More specifically, loud speaker drivers are usually placed in baffles such as boards or cabinets so that the sound can be radiated in a forward direction and at the same time inhibited from rearward direction. These baffles usually perform satisfactorily above frequencies which are greater than some cut-off frequency, the latter being dependent upon the dimensions of the baffle. For many commercially available systems, this cut-off frequency is somewhere in the range around 200 to 600 Hz depending on the size of the baffles. When the solid angle in which the low frequency sound power, or that power below the cut-off frequency, can be radiated is restricted, the low frequency sound power perceived by a listener will change. Thus, the low frequency output of a baffled diaphragm of a speaker, which is positioned on the floor in the center of a room (hereinafter the $4\pi$ position) will be radiated into air within a solid angle of approximately 180° or $4\pi$ steradians. If the same speaker is placed instead along the center of a long wall at the intersection of the floor or ceiling (hereinafter the $2\pi$ position), the wall will restrict the solid angle into which the low frequency sound power is radiated to approximately 90° or $2\pi$ steradians. Finally, if the speaker is located in a corner of the room at the intersection of two walls and the ceiling or floor (hereinafter the $\pi$ position), the solid angle in which the low frequency sound power is radiated will again be halved to 45° or $\pi$ steradians. Consequently, when many commercially available speakers are moved from the center of a room to the center of a wall or to the corner, the listener perceives an increase in the low frequency or bass output. It will be apparent that if the loudspeaker system which includes a woofer has been designed so that it is balanced for one of the three positions, the speaker will not be balanced if placed in another position.

It is therefore an object of the present invention to provide a speaker system which overcomes the aforementioned problems.

More specifically, it is an object of the present invention to provide a speaker system in which the sound power can be adjusted depending on the position of the system in a room.

Yet another object of the present invention is to provide a speaker system in which the level of sound power output can be adjusted depending on whether the system is placed in a $4\pi$, $2\pi$ or $\pi$ position.

Still another object of the present invention is to provide a speaker system which includes a woofer in which increments of power may be selectively added or subtracted to the woofer up to the cut-off frequency depending upon the position of the system within a room.

Yet another object of the present invention is to provide a compensating circuit for selectively providing a more equal sound power output which is independent of speaker position.

These and other objects are achieved by a speaker system which includes a woofer, a transformer secondary and a plurality of inductive and capacitive impedances. Switching means are provided for coupling selected taps of the transformer secondary to the woofer through selected ones of the impedances so as to selectively add or subtract, according to the switch position, the amount of sound power output.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

Figure 1:
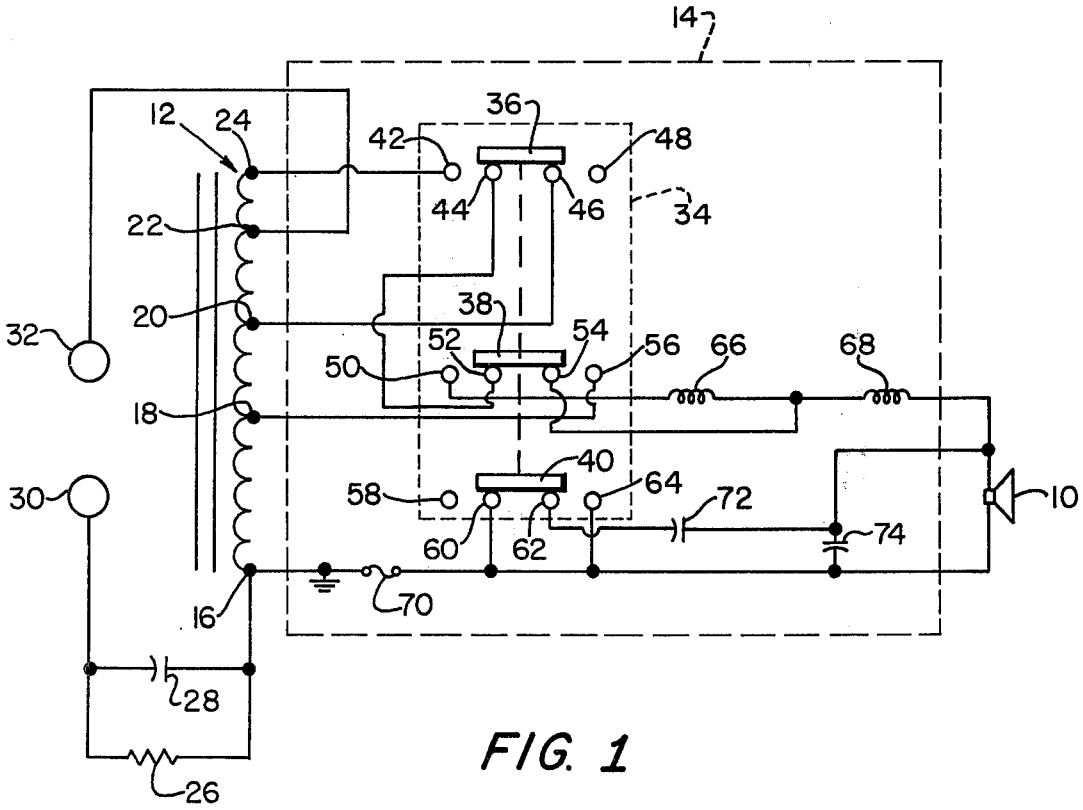

For a fuller understanding of the nature and objects of the present invention, reference should be had to the following detailed description taken in connection with the accompanying drawing wherein:

FIG. 1 is a diagram of a circuit which is designed in accordance with the principals of the present invention; and FIG. 2 is a graphical representation of the power vs. frequency response of one exemplary embodiment of the FIG. 1 circuit.

Referring to FIG. 1, the woofer 10 is coupled to a multiple tap transformer secondary 12 through the switching circuit or network 14. Woofer 10 is a type of speaker well known in the art, typically a speaker of low impedance which provides a sonic output signal over a selected range of frequencies in response to low frequency input signals, e.g., those signals at frequencies below about 525Hz. Woofer 10 is primarily used to provide bass response in a speaker system and thus may be used with mid-range speakers and high range tweeters. For example, typical mid-range speakers are responsive to those signals at frequencies between 525 and 5000 Hz while high range tweeters are typically responsive to frequencies above 5000Hz. Usually, when all three types of speakers are used in a speaker system, crossover circuits are utilized to separate low, mid and high frequency signals to each of the different type of speakers as well known to those skilled in the art, e.g., U.S. Pat. No. 3,838,215 issued to Haynes, Jr. on Sept. 24, 1974.

Multiple tap transformer secondary 12 comprises a coil which is tapped at five positions 16, 18, 20, 22 and 24. The coil is energized so that each tap is at an increasingly greater potential level. First tap 16 which is grounded, is connected to one side of a tank circuit comprising paralleled resistor 26 and capacitor 28. The other side of that tank circuit is connected to output terminal 30 of an AC power supply (not shown). Resistor 26 is primarily a swamping resistor to maintain a minimum impedance at very low frequencies to avoid amplifier blowout. Capacitor 28 limits the DC current through the transformer secondary to avoid saturation distortion. The other output terminal 32 of the audio supply is connected to the tap 22.

Switching circuit 14 is generally provided for directing power from transformer secondary 12 to the input of woofer 10 along a selected one of a plurality of impedance channels. Circuit 14 comprises three-position switch 34 having three movable contact elements 36, 38, and 40 which are ganged for motion with one another. Element 36 is movable among four contact terminals 42, 44, 46, and 48; element 38 is movable among four contact terminals 50, 52, 54, and 56; and element 40 is movable among four contact terminals 58, 60, 62, and 64. In the $4\pi$ position of the switch which provides an optimum input signal when the woofer is in its $4\pi$ position, elements 36, 38 and 40 are positioned so that the element 36 electrically connects terminals 42 and 44, element 38 electrically connects terminals 50 and 52 and element 40 electrically connects terminals 58 and 60. In the $2\pi$ position of switch 34 corresponding to an optimum signal input to woofer 10 when the latter is in its $2\pi$ position, element 36 connects terminals 44 and 46, element 38 connects terminals 52 and 54 and element 40 connects 60 and 62. Finally, in the $\pi$ switch position (corresponding to optimum input for a woofer $\pi$ position), element 36 connects terminals 46 and 48, element 38 connects terminals 54 and 56 and element 40 connects terminals 62 and 64. Terminal 42 is directly connected to tap 24 of transformer secondary 12, terminal 44 is directly connected to terminal 52, terminal 46 is directly connected to the tap 20 and terminal 48 is left unconnected. Terminal 50 is connected to one terminal of woofer 10 through two series connected inductive elements 66 and 68. The opposite terminal of the woofer 10 is connected through fuse 70 to ground tap 16. Fuse 17 protects circuit 14 from overloading currents. The junction of elements 66 and 68 is connected to terminal 54 while terminal 56 is connected to tap 18. Terminal 58 is left unconnected. Terminals 60 and 64 are connected to ground. Finally, terminal 62 is capacitively coupled to the junction of inductive element 68 and woofer 10, through the capacitive impedance element 72. This latter junction is capacitively coupled to ground through capacitive impedance element 74.

In operation, when a speaker is placed in the center of the room, switch 34 is placed in the $4\pi$ position. This results in the woofer being driven by power provided across the taps 24 and 16 of the transformer secondary 12. Further, the inductive elements 66 and 68 are placed in series with, and capacitive element 74 in parallel with woofer 10. In this switch position, the maximum power delivered to woofer 10 will be in the band of frequencies in which the inductive elements 66 and 68 and capacitive element 74 are substantially tuned.

When the speaker is placed along the center of the wall at the intersection of a floor or ceiling, switch 34 should be placed in the $2\pi$ position. This results in a lower power input since the power used to drive the woofer is taken across taps 20 and 16. In this position, only inductive element 68 is placed in series with woofer 10. However, capacitive element 72 is now connected into the circuit in parallel with capacitive element 74 and woofer 10. This results in a shift in the overall impedance of the switching circuit and as a consequence a shift in the band of frequencies in which the circuit is tuned.

When switch 34 is placed in the $\pi$ position, the power input is again decreased since the input is taken across taps 18 and 16. It is noted however, that inductive element 68 and capacitive elements 72 and 74 are still connected into the switching circuit.

By properly choosing the values of the inductive elements 66 and 68 and capacitive elements 72 and 74, the power output levels of the woofer 10 at the three switching positions can be made to differ from one another by substantially fixed magnitudes or increments (preferably about 3db) which remain substantially constant throughout an entire frequency range below some cut-off value, and thereafter decrease and become substantially zero above the cut-off frequency.

An example of a circuit which will achieve the above results has the following values for each element listed in the following tables:

TABLE I

Inductive element 66 — 1.88 mH
Inductive element 68 — 2.85 mH
Capacitive element 72 — 20 mfd
Capacitive element 74 — 100 mfd With the values set forth above, the power at tap 24 made 3db greater than the power available at tap 20 and the power at tap 18 made 3db less than that available at tap 20, woofer 10 will have a power-frequency response as illustrated in FIG. 2. The dotted line in FIG. 2 represents the power (in db) to frequency ratio (P/F) for the woofer when switch 34 is in its $4\pi$ position and the speaker should thus be positioned in the middle of a room. Similarly, the solid line in FIG. 2 represents P/F for the woofer when switch 34 is in its $2\pi$ position and the dashed line represents P/F for the woofer when switch 34 is in its $\pi$ position. As shown, the increments of low frequency sound power output added or subtracted (depending on whether the switch is placed in the $4\pi$, $2\pi$ or $\pi$ positions) is fairly constant at 3db up to about 200Hz, wherein the differences begin to decrease. The differences continue to decrease until the sound power output in any of the three positions is about the same at about 350Hz, which for many of the commercially available speakers is at or near the cut-off frequency at which the baffles will suitably direct the sound power output in the direction intended.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A loudspeaker system for providing a substantially uniform sound power output as perceived by the listener independent of the position thereof in a room; and including a woofer for providing a sonic signal over a selected range of frequencies, said system comprising, in combination:

a transformer secondary constituting an electrical power source; and means for coupling selected taps on said transformer secondary to said woofer, said means for coupling comprising a switching network for directing power input to said woofer along one of a plurality of impedance channels of substantially fixed reactances selected depending upon the location of said woofer so that the actual sound power output available from said woofer differs over said frequency range according to the selected one of said channels by substantially fixed magnitudes compared to the actual sound power outputs respectively available from said woofer over said frequency range when the latter is energized by power along each of the others of said channels.

2. The system of claim 1 wherein said means for coupling further includes a plurality of inductive and capacitive impedances, and wherein said plurality of channels are each determined by selected ones of said impedances.

3. The system of claim 2 wherein said switching network is positionable among one of the three positions depending upon the location of said woofer.

4. The system of claim 3, wherein the first position of said switch is utilized when said woofer is located so that sound power within said selected range of frequencies is radiated in a solid angle of substantially $4\pi$ steradians, the second position of said switch is utilized when said woofer is located so that sound power within said selective range of frequencies is radiated in a solid angle substantially of $2\pi$ steradians, and the third position of said switch is utilized when said woofer is located so that sound power within said selective range of frequencies is radiated in a solid angle of substantially $\pi$ steradians.

5. The system of claim 4, wherein said plurality of inductive and capacitive impedances comprise first and second inductive elements and first and second capacitive elements.

6. The system of claim 5, wherein in said first position said first and second inductive elements are connected in series with, and said first capacitive element is connected in parallel with said woofer and said second capacitive element is disconnected; and in said second and third positions said first inductive element is connected in series with and said first and second capacitive elements are connected in parallel with said woofer, and said second inductive element is disconnected.

7. The system of claim 6, wherein said first inductive element has an approximate value of 2.85 mH, said second inductive element has an approximate value of 1.88 mH, said first capacitive element has an approximate value of 100 mfd, and said second capacitive element has an approximate value of 20 mfd.

8. The system of claim 1, further including means for limiting the DC current through said transformer to prevent saturation distortion.

9. The system of claim 1, further including means for connecting said transformer secondary to an AC power supply, and means for maintaining minimum impedances below a predetermined frequency between said transformer and said power supply.

10. The system of claim 1, wherein said fixed magnitudes of actual sound power output are approximately 3db and 6db throughout said selected range of frequencies.

11. A method of changing the actual sound power output of a woofer over a selected range of frequencies so that said woofer provides a substantially uniform sound power output as perceived by the listener independent of the location of said woofer comprising the steps of:

electrically coupling said woofer through a plurality of impedance channels of substantially fixed reactances to selected taps of a transformer secondary;

selectively directing the power input to said woofer along a selected one of said plurality of channels depending on the position of said woofer so that the actual sound power output available from said woofer, according to the selected one of said channels, differs over said frequency range by substantially fixed magnitudes compared to the actual sound power outputs respectively available from said woofer when the latter is energized by power along each of the others of said channels.

* * * * *